US006485571B1

(12) United States Patent
Graf

(10) Patent No.: US 6,485,571 B1
(45) Date of Patent: Nov. 26, 2002

(54) PAPER MANUFACTURING AND PROCESSING MACHINE WITH CLOSED LOOP CONTROL SYSTEM

(75) Inventor: Edwin X. Graf, Monasha, WI (US)

(73) Assignee: Voith Sulzer Paper Technology North America, Inc., Appleton, WI (US)

( * ) Notice: Subject to any disclaimer, the term of this patent is extended or adjusted under 35 U.S.C. 154(b) by 50 days.

(21) Appl. No.: 09/619,776

(22) Filed: Jul. 20, 2000

Related U.S. Application Data

(63) Continuation-in-part of application No. 09/358,722, filed on Jul. 21, 1999, now Pat. No. 6,290,816.

(51) Int. Cl.[7] ..... B05C 1/04

(52) U.S. Cl. ..... 118/663; 118/664; 118/665; 118/667; 118/708; 118/712

(58) Field of Search ..... 162/262–263, 162/265, DIG. 2, 10, 11, 135, 198; 118/663–667, 708, 712; 428/8; 700/123, 127, 129

(56) References Cited

U.S. PATENT DOCUMENTS 3,596,071 A * 7/1971 Doering ..... 700/123
5,453,625 A * 9/1995 Lawson et al. ..... 250/459.1
5,712,489 A * 1/1998 Elvidge et al. ..... 250/559.43
5,715,158 A 2/1998 Chen ..... 364/150
5,935,637 A * 8/1999 Caldwell et al. ..... 427/8
6,026,334 A * 2/2000 Kayihan et al. ..... 700/28
6,074,483 A * 6/2000 Belotserkovsky et al. .. 118/665
6,086,716 A 7/2000 Watson ..... 162/198

* cited by examiner

*Primary Examiner*—Laura Edwards
(74) *Attorney, Agent, or Firm*—Taylor & Aust, P.C.

(57) ABSTRACT

A machine for one of manufacturing and processing a fiber web includes an input end which receives a fiber suspension or a fiber web. The input end includes a plurality of control modules, with each control module controlling at least one of a plurality of adjustable input parameters. A plurality of sensors are provided, with each sensor being configured to sense a physical characteristic of one of the fiber suspension and the fiber web and provide an output signal indicative thereof. A chemistry process controller is coupled with each sensor and each control module to define a closed loop control system. The chemistry process controller controls operation of each control module.

1 Claim, 3 Drawing Sheets

PAPER MANUFACTURING AND PROCESSING MACHINE WITH CLOSED LOOP CONTROL SYSTEM

CROSS REFERENCE TO RELATED APPLICATIONS

This is a continuation-in-part of U.S. patent application Ser. No. 09/358,722, entitled "PAPER MACHINE WITH CLOSED LOOP CONTROL SYSTEM", filed Jul. 21, 1999 now U.S. Pat. No. 6,290,816.

BACKGROUND OF THE INVENTION

1. Field of the Invention.

The present invention relates to machines for manufacturing and processing fiber webs, and, more particularly, to a control system used to control physical components of such machines.

2. Description of the related art.

Machines for manufacturing and processing fiber webs can generally be classified as paper machines and off-line coaters. A paper machine receives a prepared fiber suspension and produces a fiber web, such as a paper web. The physical parameters of the fiber suspension which is supplied to the paper machine, such as the pressure, temperature, chemical content, etc. in turn affect the physical characteristics of the fiber web manufactured by the paper machine. It is known to laboratory test a small portion of the fiber web to determine the physical characteristics thereof. After the fiber web is tested, valves, feed screws, pumps or the like may be manually actuated to add a predetermined amount of energy (e.g., heat) or chemical (e.g., calcium carbonate, titanium dioxide, etc.) to the fiber suspension to affect the physical characteristics of the manufactured web. Since this process is manually adjusted, the delay time between obtaining a sample of paper and finally adjusting a device within the approach flow system may be extensive. This means that a relatively large amount of paper may be produced which does not have optimum physical characteristics.

An off-line coater treats a fiber web with one or more coatings to provide desired physical properties to the fiber web, such as brightness, color, surface finish etc. The coater typically receives a large roll of the fiber web, unwinds and coats the fiber web, and rewinds the fiber web after coating.

Regardless whether the fiber web is manufactured using a paper machine or coated using an off-line or on-line coater, the quality of the fiber web must be continually monitored to assure a high quality fiber web as an end product. Certain inherent inefficiencies exist in the manual lab testing techniques commonly employed, as described above.

What is needed in the art is a paper machine which automatically adjusts for at least some of the physical parameters associated with the fiber suspension and/or fiber web to thereby improve the quality of the fiber web.

SUMMARY OF THE INVENTION

The present invention provides a chemical process controller which receives input signals from a plurality of sensors spaced along the length of the paper machine, and which controls various control modules of an approach flow system which provides a fiber suspension to a wet end of the paper machine.

The invention comprises, in one form thereof, a paper machine for making a fiber web, including an approach flow system including a plurality of control modules. Each control module controls one of 4 plurality of adjustable input parameters. A wet end receives a fiber suspension from the approach flow system, and includes a headbox which discharges a fiber suspension with a known cross sectional profile onto a wire. A press section, forming section and drying section are used to press, form and dry the fiber web, respectively. A plurality of sensors are respectively positioned in association with the approach flow system, wet end, press section, forming section and/or drying section. Each sensor is configured to sense a physical characteristic of the fiber web and provide an output signal indicative thereof. A chemistry process controller is coupled with each sensor and each control module within the approach flow system to define a closed loop control system. The chemistry process controller controls operation of each control module.

The invention comprises, in yet another form thereof, a machine for one of manufacturing and processing a fiber web. An input end receives a fiber suspension or a fiber web. The input end includes a plurality of control modules, with each control module controlling at least one of a plurality of adjustable input parameters. A plurality of sensors are provided, with each sensor being configured to sense a physical characteristic of one of the fiber suspension and the fiber web and provide an output signal indicative thereof. A chemistry process controller is coupled with each sensor and each control module to define a closed loop control system. The chemistry process controller controls operation of each control module.

An advantage of the present invention is that the physical parameters of the fiber suspension are controlled using a closed loop control system, thereby avoiding the necessity to manually adjust valves, pumps or the like.

A further advantage is that output signals from the sensors may be utilized almost instantaneously to provide a fiber suspension with desired physical parameters to the wet end of the paper machine.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
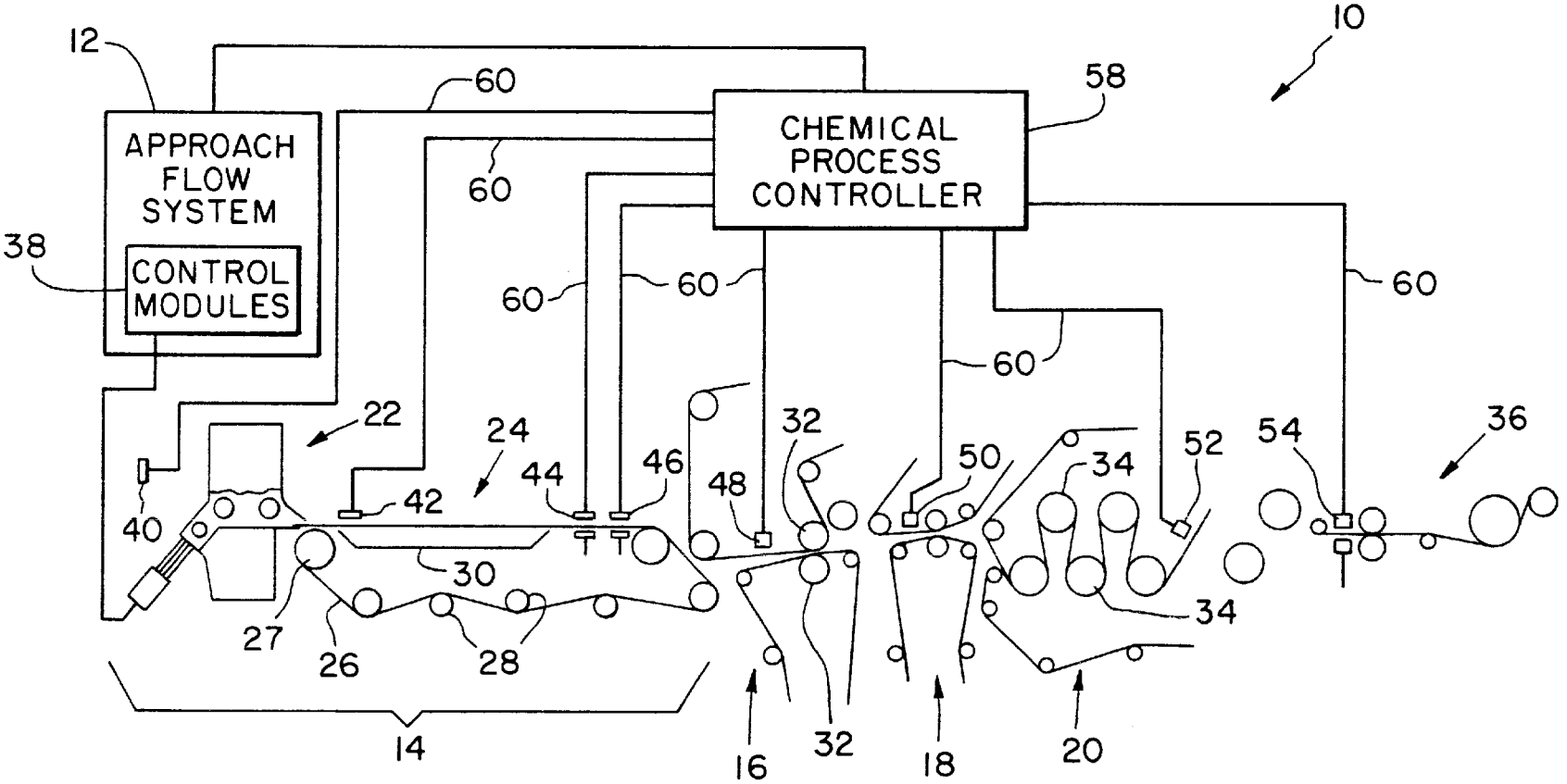
FIG. 1 is a schematic, side view of an embodiment of a machine of the present invention in the form of a paper machine.

Referring now to the drawings, and more particularly to FIG. 1, there is shown an embodiment of a paper machine 10 of the present invention for making a fiber web, such as a paper web. Paper machine 10 generally includes an approach flow system 12, wet end 14, press section 16, forming section 18 and drying section 20.

Unless otherwise noted, details familiar to persons skilled in the electronic arts will be omitted since they are extraneous detail and thus have no bearing on reducing the invention to practice. Moreover, it is also to be understood, and it will be appreciated by those skilled in the art, that the methodology and logic of the present invention described herein may be carried out using any number of structural configurations such as electronic hardware, software, and/or firmware, or the like.

Wet end 14 includes a headbox 22 and a fordrinier section 24. Headbox 22 receives a prepared fiber suspension from approach flow system 12, and discharges the fiber suspension with a controlled cross sectional profile from a discharge outlet onto a wire 26 of fordrinier section 24. Fordrinier section 24 also includes a couch roll 27 positioned adjacent to the discharge outlet of headbox 22. Breast roll 27 may be moved in an oscillatory manner in an axial direction (perpendicular to the drawing of FIG. 1) to induce a fluid shear within the fiber suspension which is discharged onto wire 26. Wire 26 is carried by couch roll 27 and a plurality of rolls 28 in an endless matter. Water within the fiber suspension drains through wire 26 and is collected within a tray 30. The water collected within tray 30 may be recycled for further use within paper machine 10.

The fiber web is transferred from fordrinier section 24 to press section 16, including two press rolls 32. Press rolls 32 may be, e.g., in the form of extended nip press rolls or the like for pressing water from a fiber web. Press section 16 may include other pressing configurations, such as press shoes, etc.

Forming section 18 forms the fiber suspension to define a fiber web with a desired cross sectional profile. Forming section 18 may include a forming section with forming blades, etc. to form the cross sectional profile of the fiber web which travels therethrough.

Drying section 20 dries the fiber web to a desired moisture content before the web is wound into a roll. Drying section 20 includes a plurality of dryer cylinders 34 which heat and dry the fiber web, in known manner. A dried fiber web is transferred to a winding station 36 for winding the fiber web into a roll.

Approach flow system 12 provides a fiber suspension with predetermined physical properties to headbox 22 for formation of the fiber web. Approach flow system 12 includes a plurality of control modules 38 for controlling one or more adjustable input parameters which affect the physical characteristics of the fiber suspension which is supplied to headbox 22. Control modules 38 can have varied configurations, and thus are indicated schematically in FIG. 1. Generally, control modules 38 are used to control or add a chemical which affects the physical properties of the fiber suspension. Alternatively, control modules 38 may include other devices for affecting the physical properties of the fiber suspension, such as a heat source which affects the viscosity of a fiber suspension, etc.

Conventionally, approach flow system 12 may include a manually adjustable valve or the like which is manually actuated to control the addition of a chemical or heat to the fiber suspension. Contrarily, control modules 38 of the present invention are electrically controllable to control the addition of heat or a chemical to the fiber suspension. For example, a control module 38 may be in the form of a steam valve to heat white water; a valve for adding sodium hydroxide (NaOH) to adjust a pH of the fiber suspension; a valve and/or screw feeder for adding calcium carbonate ($CaCO_3$); a valve for adding sulfuric acid ($H_2SO_4$); a valve for adding aluminum hydroxide ($Al_2H_2SO_4$); a valve and/or pump for adding a first retention additive; a valve and/or pump for adding a second retention additive; a valve for adding rosin size; or a valve and/or screw feeder for adding titanium dioxide ($TiO_2$).

Paper machine 10 also includes a plurality of sensors 40–54 which sense different physical characteristics of the fiber suspension or fiber web along the running length of paper machine 10. Sensors 40–54 may be, e.g., in the form of a pressure sensor, gamma backscatter sensor, ultrasound sensor, optical sensor, temperature sensor and/or flow meter, depending upon the particular physical characteristics of the fiber suspension and/or fiber web being sensed. For example, sensor 40 may be used to sense a fiber stock pH; stock temperature; zeta potential; consistency of the fiber suspension; total pressure head; flow rate of the fiber suspension to wet end 14; and/or percent of entrained air in the fiber stock. The zeta potential generally relates to an amount of electrical charge on the individual fibers within the fiber suspension, and indirectly relates to an amount of anionic trash within the fiber suspension.

Moreover, sensor 42 could be used to sense the formation of the fibers within the fibers suspension which is discharged onto wire 26; a traveling speed of wire 26; the consistency of the fiber suspension immediately after couch roll 27; and/or a flow rate of the water which is collected and transported away from tray 30. The formation of the fiber suspension relates to the orientation of the fibers within the fiber suspension, relative to the traveling direction of wire 26. The flow rate of the water within tray 30 correlates to the retention characteristics of the fibers within the fiber suspension provided by approach flow system 12.

Sensors 44–54 may likewise be used to sense physical characteristics associated with the fiber web which can be affected by the physical characteristics of the fiber suspension which is provided by approach flow system 12.

Chemical process controller 58 is coupled with and receives an input signal from each of sensors 40–54. More particularly, chemical process controller 58 is coupled with each sensor 40–54 via a corresponding electrical conductor 60. Chemical process controller 58 could also be coupled with one or more of sensors 40–54 in another suitable manner, such as by using an infrared (IR) link, etc.

Chemical process controller 58 is also electrically connected with and controls operation of control modules 38 within approach flow system 12. More specifically, chemical process controller 58 receives input signals from sensors 40–54 and provides one or more output signals to one or more control modules 38 within approach flow system 12. The control signals provided by chemical process controller 58 are used to actuate and/or controllably adjust operation of one or more control modules 38 to affect the physical characteristics and/or physical parameters (used synonymously to cover chemical and non-chemical related attributes) of the fiber suspension which is provided to headbox 22. In this manner, a closed loop control system is defined which better controls operation of paper machine 10 and provides a high quality fiber web as a final product. Since control modules 38 are electrically controlled via chemical process controller 58, approach flow system 12 preferably includes a plurality of control modules 38 to better control the physical parameters and/or physical characteristics of the fiber suspension provided to headbox 22. In the embodiment shown, approach flow system 12 includes three or more control modules 38. Controlling a single control module may not be effective since altering one input parameter may affect another (e.g., adding heat may affect a chemical reaction; adding one chemical may affect another chemical, etc.).

Figure 2:
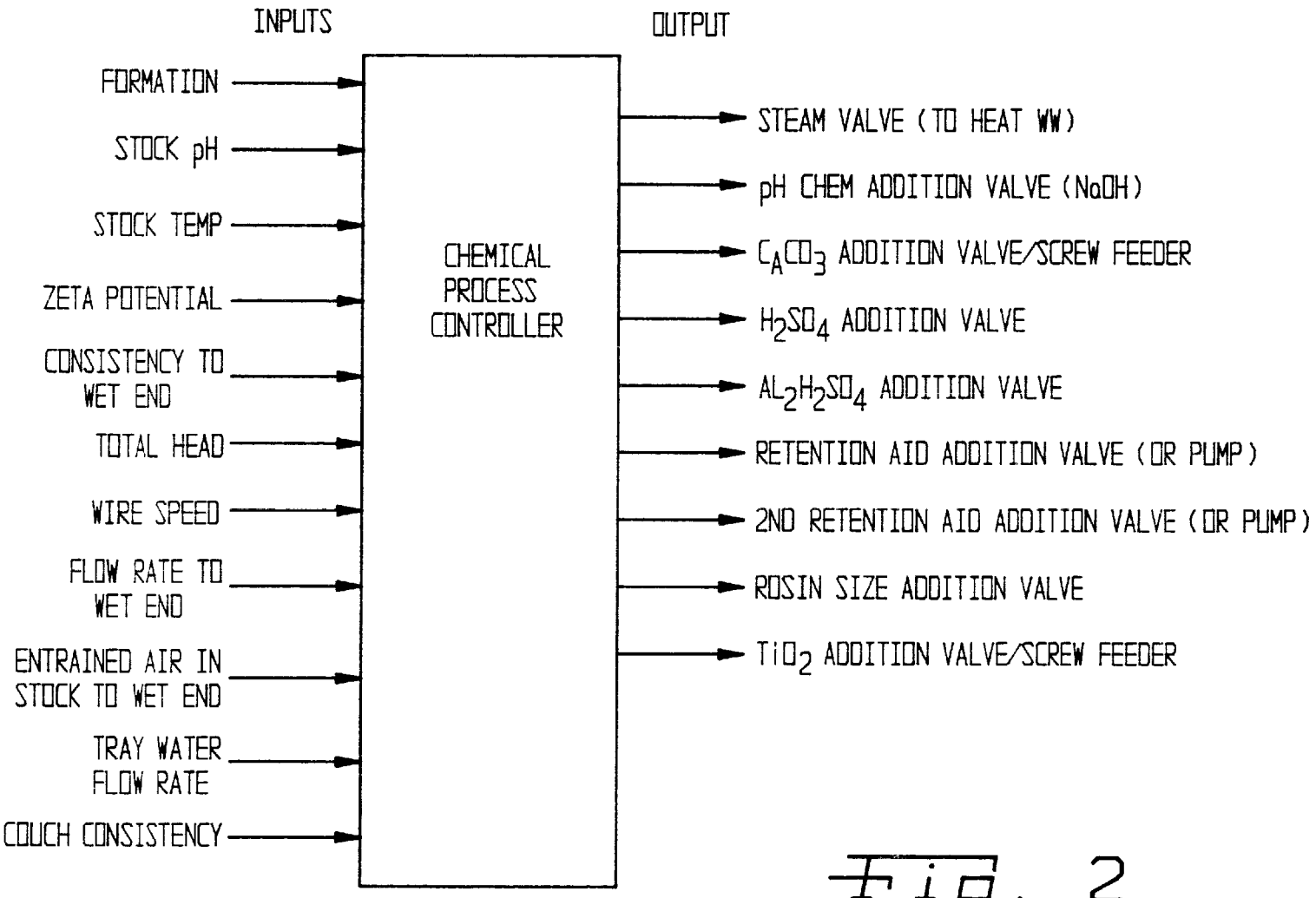
FIG. 2 is a graphical illustration of the inputs and outputs of the chemical process controller used in the paper machine of the present invention.

In the embodiment shown in FIGS. 1 and 2, chemical process controller 58 is configured as a digital control system (DCS) including a microprocessor based computer with onboard software which utilizes values of various input signals as described above to control operation of control modules 38. The DCS may be of suitable design, such as a mini-computer, main frame computer, etc. The software on board the DCS may be in any suitable form, such as C, C++, assembly language, fortran, pascal, etc. and may carry out control based upon calculations and/or look-up tables. Other configurations of chemical process controller 58 are of course possible, such as a programmable logic controller (PLC), etc.

Figure 3:
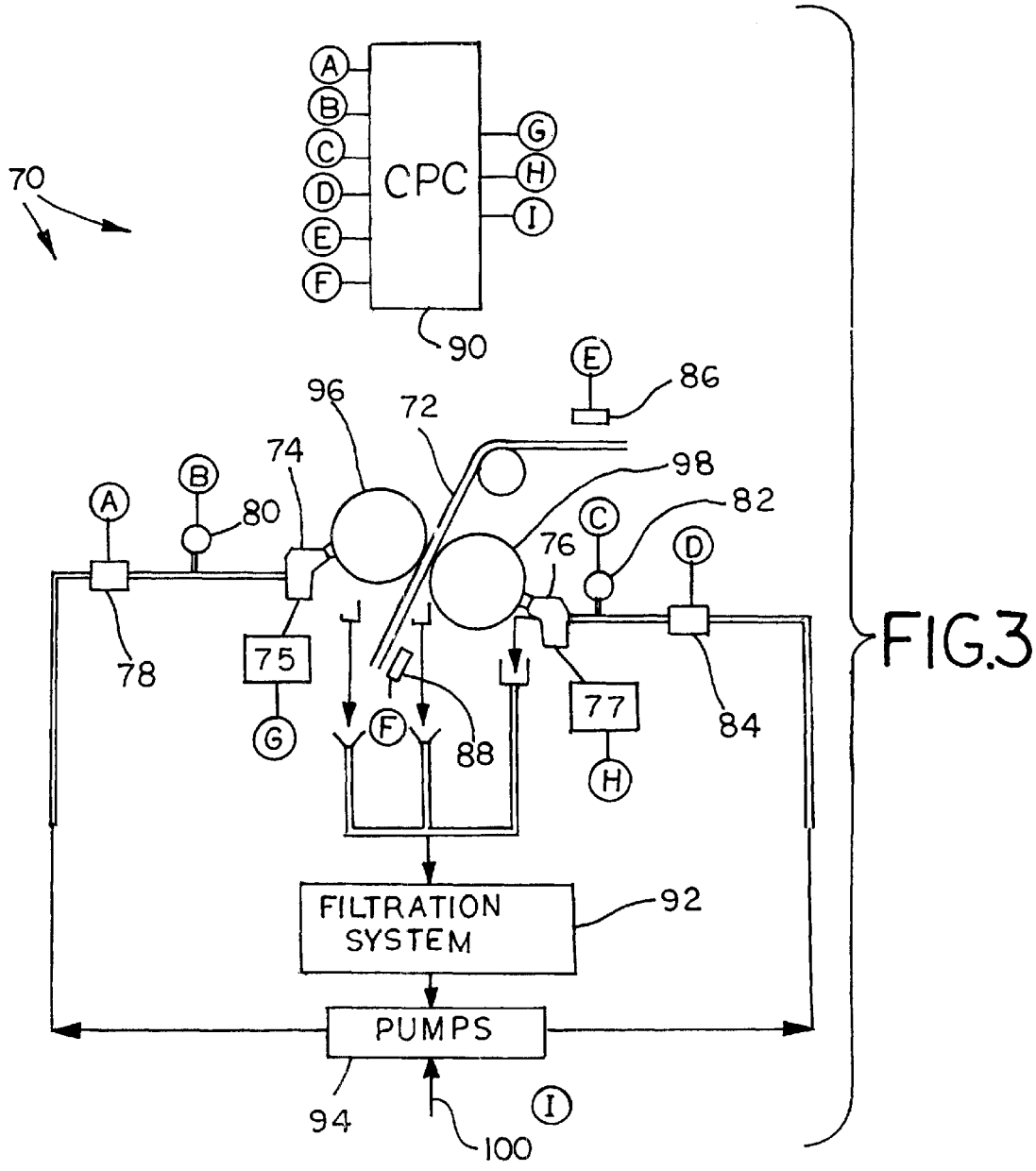
FIG. 3 is a schematic view of another embodiment of a machine of the present invention in the form of an off-line or on-line coater.

Referring now to FIG. 3, there is shown another embodiment of a machine of the present invention in the form of an off-line coater 70 for coating a fiber web 72. Coater 70 generally includes a pair of coating applicator systems 74 and 76, a plurality of sensors 78, 80, 82, 84, 86 and 88, a chemistry process controller (CPC) 90, a filtration system 92 and a plurality of pumps 94.

Coating applicator systems 74 and 76 are used to apply a coating to opposite sides of fiber web 72. In the embodiment shown, coating applicator systems 74 and 76 apply a coating to a respective roll 96 and 98, which in turn applies the coating to a respective side of fiber web 72. Coating applicator systems 74 and 76 thereby apply a coating to both sides of fiber web 72 in an indirect manner.

Sensors 78 and 80 are positioned upstream from coating applicator system 74; and sensors 82 and 84 are positioned upstream from coating applicator system 76. Sensors 78 and 84 are each in the form of flow monitoring sensors which sense the volumetric flow rate of the coating mixture which is applied to fiber web 72. Sensors 80 and 82 are configured as solids monitoring sensors which are used to sense suspended solids within the coating mixture by sensing the consistency or viscosity of the coating mixture. Sensors 78, 80, 82 and 84 are each electrically coupled with CPC 90, as indicated by reference letters A, B, C and D, respectively, and thereby provide input signals to CPC 90.

Sensors 86 and 88 are each positioned in association with fiber web 72 to sense selected physical properties of fiber web 72 before and after application of the coating medium, respectively. Sensors 86 and 88 are provided as a sensor package with a plurality of discrete sensor elements therein. Discrete sensor elements within each sensor 86 and 88 may sense at least one of opacity; color; moisture; bone dry weight; caliper; and coating temperature. Sensors 86 and 88 are each electrically coupled with CPC 90, as indicated by reference letters E and F, respectively, and thereby provide input signals to CPC 90 indicative of physical parameters sensed by the individual sensor elements positioned therein. Sensor packages 86 and 88 may be positioned with respect to only a portion of the width of fiber web 72, or may extend across the entire width of fiber web 72. It is thus possible to determine the coating weight in the machine direction and the coating weight profile in the cross machine direction.

Coating applicator systems 74 and 76 each include one or more control modules 75 and 77, respectively associated therewith. Coating applicator systems 74 and 76 are electrically coupled with CPC 90, as indicated by reference letters G and H, and thereby receive control signals from CPC 90. Coating applicator systems 74 and 76 are thus controlled using the values of various input signals received by CPC 90 from input sensors 78, 80, 82, 84, 86 and 88.

CPC 90 also is electrically coupled with pumps 94 to controllably actuate pumps 94 based upon the values of input signals received from sensors 78–88. For example, if pumps 94 are configured as fixed geometry pumps, the rotational speed of each pump 94 may be controllably varied dependent upon the input signals received from sensors 78–88.

During use, sensors 78–88 provide various input signals to CPC 90. Pumps 94 receive filtered coating mixture from filtration system 92, and also receive coating mixture as indicated at line 100. Physical characteristics of fiber web 72 are sensed before and after application of the coating mixture using sensor packages 86 and 88. Each sensor package 86 and 88 includes a number of discrete sensor elements which sense a number of physical characteristics associated with fiber web 72, and thereby provide signals to CPC 90 representing the coating weight in the machine direction or coating weight profile in a cross-machine direction. The coating composition, coating weight and/or cross-machine coating weight profile may be controllably varied using CPC 90.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A coater for coating a fiber web, comprising:

a coating applicator system configured for applying at least one coating to the fiber web, said coating applicator system including a plurality of control modules, each said control module controlling at least one of a plurality of chemical and physical adjustable input parameters;

a plurality of sensors at least one sensor positioned upstream of said coating applicator system and at least one sensor positioned downstream of said coating applicator system, each said sensor associated with said coating applicator system to sense a physical characteristic of the fiber web and provide an output signal indicative thereof, at least one said sensor sensing one of opacity color, caliper and coating temperature; and a chemistry process controller coupled with each said sensor and each said control module to define a closed loop control system, said chemistry process controller controlling operation of each said control module.

* * * * *